US005634648A

United States Patent [19]

Tonel et al.

[11] Patent Number: 5,634,648

[45] Date of Patent: Jun. 3, 1997

[54] ROLLER SKATE WITH IMPROVED FIT

[75] Inventors: Valerio Tonel, Biadene; Roberto Gorza, Feltre; Francesco Caeran, Montebelluna, all of Italy

[73] Assignee: Nordica S.p.A., Trevignano, Italy

[21] Appl. No.: 451,621

[22] Filed: May 26, 1995

[30] Foreign Application Priority Data

Jun. 8, 1994 [IT] Italy ..... TV94A0063

[51] Int. Cl.[6] ..... A63C 17/04

[52] U.S. Cl. ..... 280/11.22; 280/11.27; 36/115

[58] Field of Search ..... 280/891, 11.19, 280/11.15, 11.2, 11.22, 11.23, 11.26, 11.27, 11.28, 11.3; 36/115, 120, 121

[56] References Cited

U.S. PATENT DOCUMENTS

| | | | |
|---|---|---|---|
| 1,228,544 | 6/1917 | Falstrem et al. | 280/11.15 |
| 1,603,588 | 10/1926 | Eberle | 280/11.15 |
| 3,114,562 | 12/1963 | Goodman | 280/11.3 |
| 3,900,203 | 8/1975 | Kukulowicz | 280/11.22 |
| 3,936,061 | 2/1976 | Wada | 280/11.23 |
| 4,061,348 | 12/1977 | Carter . | |
| 4,108,450 | 8/1978 | Cote | 280/11.22 |
| 4,126,323 | 11/1978 | Scherz | 36/115 |
| 4,272,090 | 6/1981 | Wheat | 280/11.22 |
| 4,839,972 | 6/1989 | Pack et al. | 36/120 |
| 5,184,834 | 2/1993 | Yu | 280/11.26 |
| 5,342,071 | 8/1994 | Soo | 280/11.22 |
| 5,397,141 | 3/1995 | Hoshizaaki et al. | 280/11.22 |
| 5,435,579 | 7/1995 | Pozzobon | 280/11.2 |
| 5,484,149 | 1/1966 | Lee | 280/11.22 |

FOREIGN PATENT DOCUMENTS

| | | | |
|---|---|---|---|
| 551704A2 | 7/1993 | European Pat. Off. | 280/11.2 |
| 568878 | 11/1993 | European Pat. Off. | 280/11.2 |
| 0599043 | 6/1994 | European Pat. Off. . | |
| 2672812 | 8/1992 | France | 280/11.26 |
| 9209340 | 6/1992 | WIPO . | |
| 9211908 | 7/1992 | WIPO . | |

*Primary Examiner*—Brian L. Johnson
*Assistant Examiner*—Min Yu
*Attorney, Agent, or Firm*—Guido Modiano; Albert Josif

[57] ABSTRACT

Roller skate with improved fit which includes a first front body for supporting and securing the front part of the foot and a second rear body for supporting and securing at least the heel. These bodies are rotatably associated with each other, and each body is provided with a supporting frame for at least one wheel. The articulation between the first body and the second body allows easier skating in improved comfort conditions.

18 Claims, 4 Drawing Sheets

ROLLER SKATE WITH IMPROVED FIT

BACKGROUND OF THE INVENTION

The present invention relates to a roller skate with improved fit.

Conventional skates are constituted by a shoe associated with a support for a pair of front wheels and a pair of rear wheels.

The rigidity of the shoe support is a drawback for these conventional skates, because during sports practice, and particularly during the pushing action, the user applies the efforts mainly at the sole region below the metatarsal area, with a tendency to articulate the foot.

The rigidity of the shoe support, as well as the possible rigidity of the shoe sole, prevent the achievement of these conditions, since the pushing force must be transmitted so that the sole of the foot is resting fully and so that the forces are transmitted both to the front pair of wheels and to the rear pair of wheels, consequently losing effectiveness in the pushing action.

Skates are also known which are constituted by a shoe that comprises a quarter articulated at a shell. A usually U-shaped frame is associated with the shell and has in-line wheels.

Even this solution has the drawbacks described above, since it limits both the effectiveness of the pushing action and the comfort of the foot, which must be kept rigid at the sole during the various movements required to achieve pushing.

SUMMARY OF THE INVENTION

The aim of the present invention is to solve the above-mentioned problems, eliminating the drawbacks of the prior art, by providing a roller skate that allows the user to optimally transmit forces during the pushing action and at the same time allows anatomically correct foot movements.

Within the scope of this aim, an important object is to provide a skate that allows to transmit forces during the pushing action selectively only at the front region of the foot.

Another important object is to provide a skate that allows, during the pushing action, to reduce as much as possible friction between the ground and the wheels.

Another important object is to provide a skate that offers optimum fit for the user during sports practice and particularly during the pushing action.

This aim, these objects, and others which will become apparent hereinafter are achieved by a roller skate with improved fit, characterized in that it comprises a first front body for supporting and securing the front part of the foot and a second rear body for supporting and securing at least the heel, said front body being rotatably associated with said rear body.

Advantageously, the first front body and the second rear body accommodate an innerboot.

BRIEF DESCRIPTION OF THE DRAWINGS

Further characteristics and advantages of the present invention will become apparent from the following detailed description of two particular but not exclusive embodiments thereof, illustrated only by way of non-limitative example in the accompanying drawings, wherein.

DESCRIPTION OF THE PREFERRED EMBODIMENTS

Figure 1:
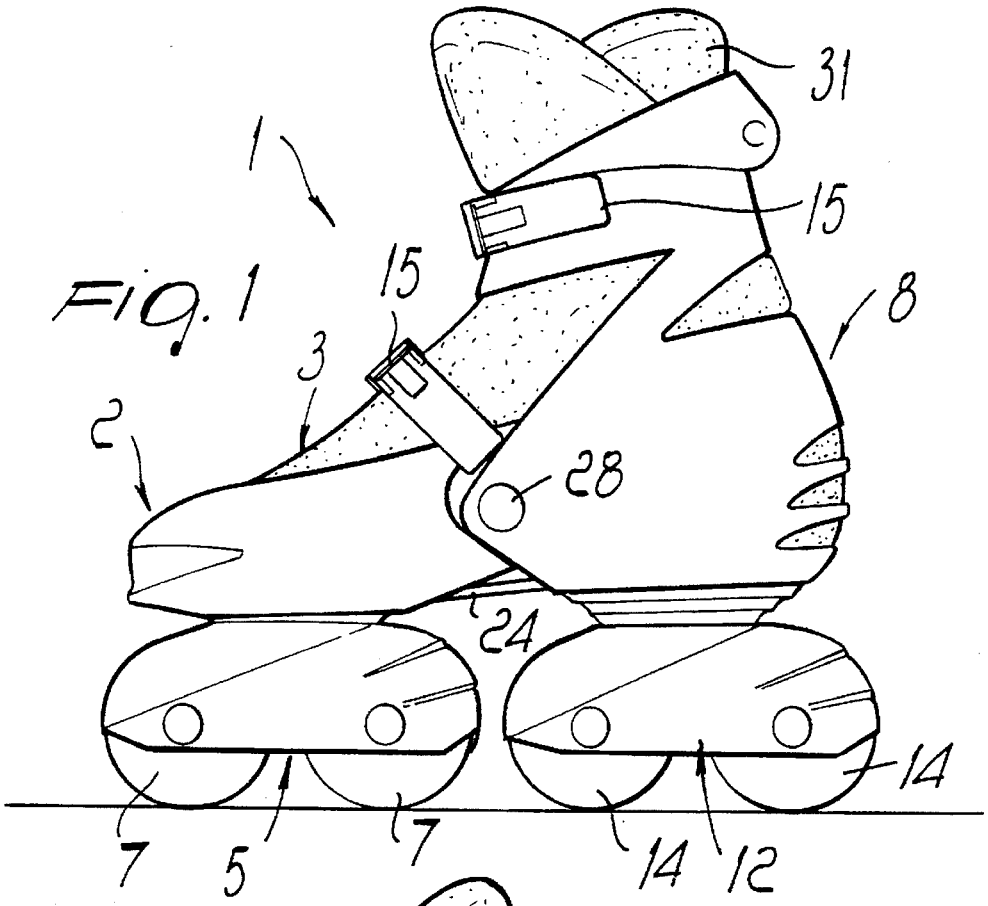
FIG. 1 is a side view of the skate according to the invention during normal skating.
Figure 2:
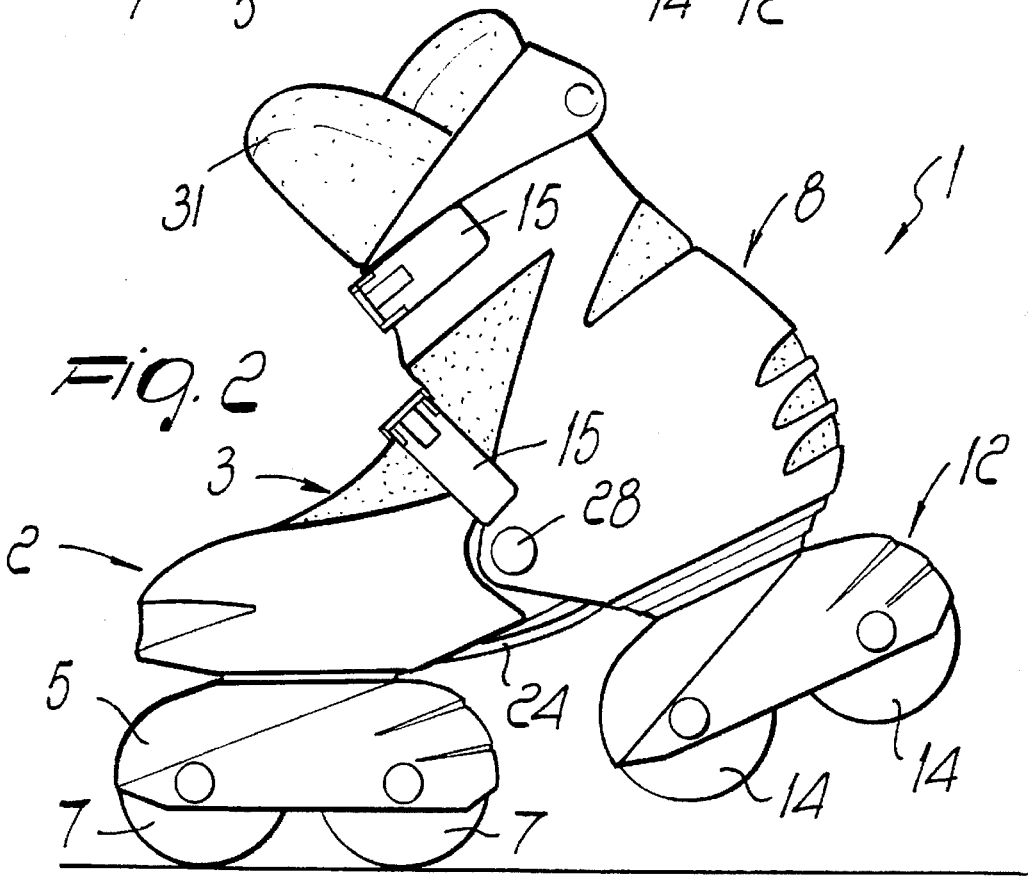
FIG. 2 is a view, similar to the preceding one, of the condition assumed by the skate during the pushing action.
Figure 3:
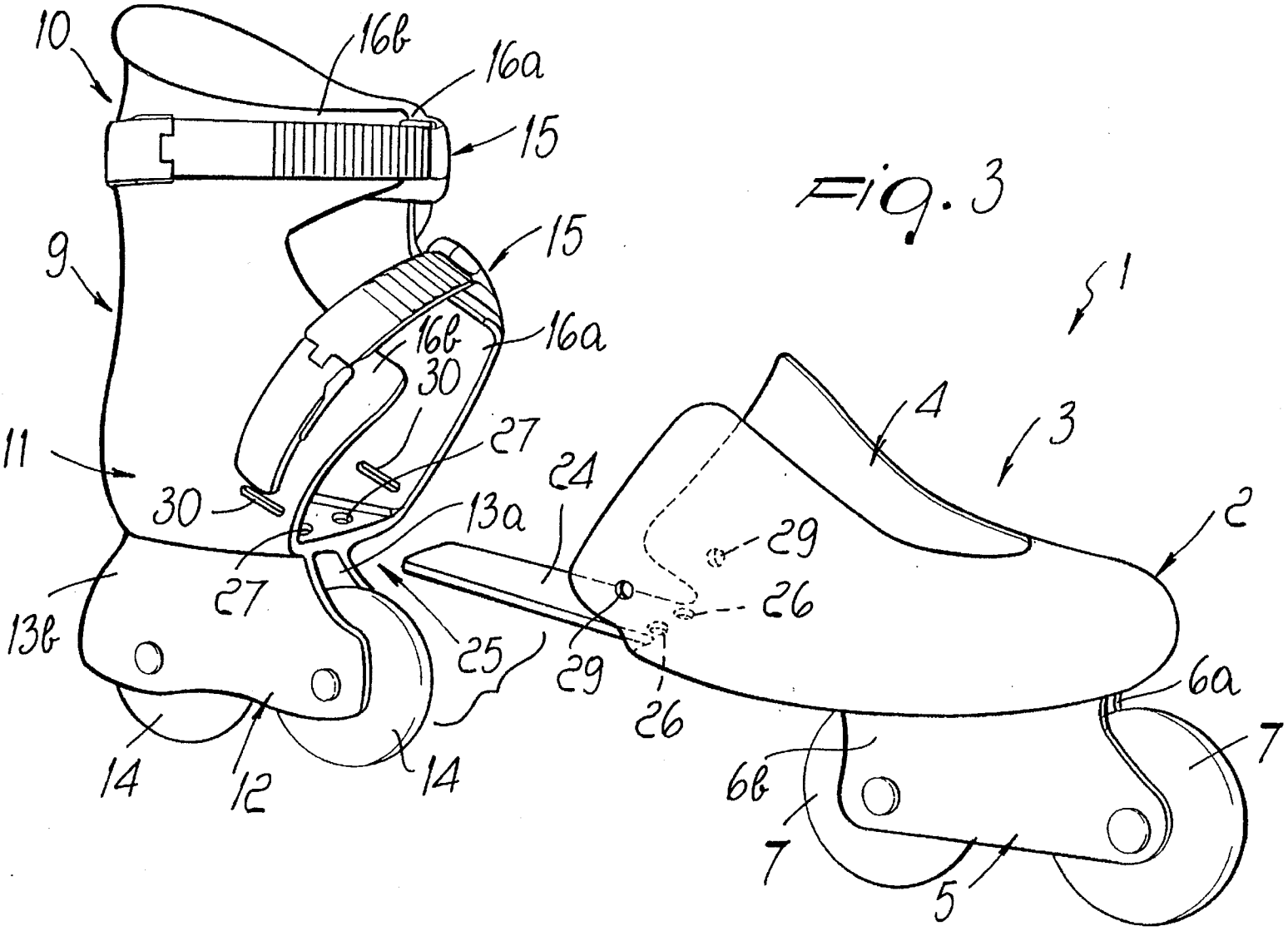
FIG. 3 is a lateral perspective exploded view of the skate.

With reference to the above figures, the reference numeral 1 designates a skate constituted by a first front body 2 forming a shell that surrounds and secures the front region 3 of the foot. The front body 2 is open at the rear and is provided with an upper longitudinal opening 4.

A first substantially U-shaped frame 5 is associated below the first body 2 in the particular embodiment illustrated herein, and two first mutually aligned wheels 7 are rotatably associated between the first wings 6*a* and 6*b* of said frame.

The first front body 2 is slidingly and rotatably associated with a second rear body 8 that is constituted by a monolithic unit formed by a cuff 9 surrounding the tibial region 10 and the heel region 11.

Said second rear body 8 is open at the front, and a second frame 12 is associated therewith below the heel region 11. Said second frame has a U-shaped cross-section, and second mutually aligned wheels 14 are rotatably associated between its second wings 13*a*, 13*b*.

The tibial region 10 and the heel region 11 are secured by means of adapted levers 15 that transversely connect the flaps 16*a* and 16*b* of the second rear body 8.

Figure 4:
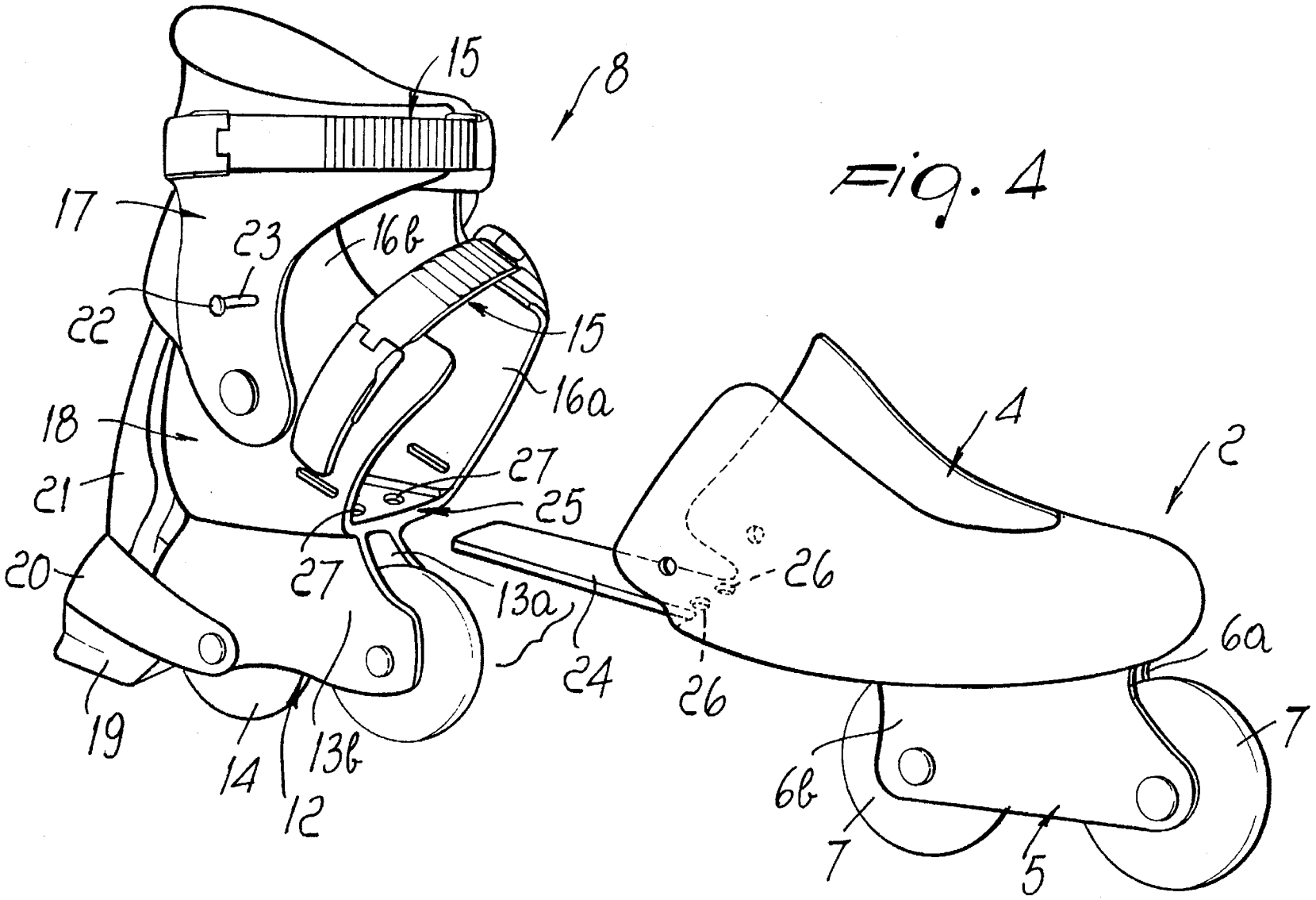
FIG. 4 is a view, similar to the preceding one, of a skate according to the invention provided with a brake.
Figure 6:
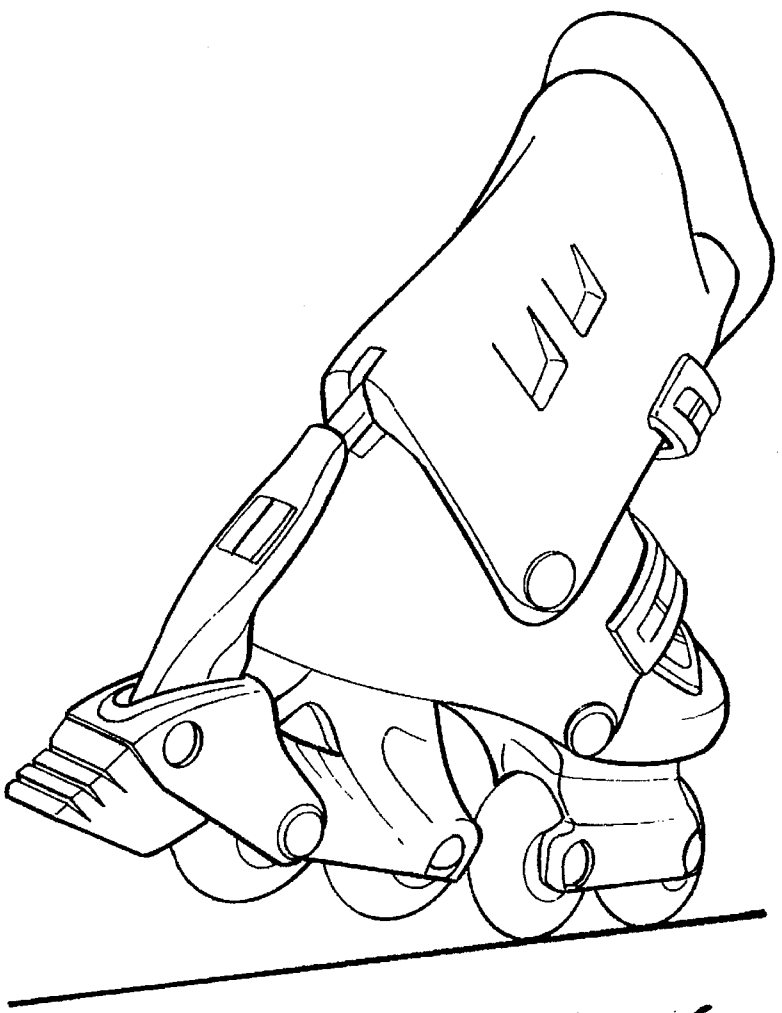
FIG. 6 shows the skate of FIGS. 4, 5 during the pushing action.
Figure 5:
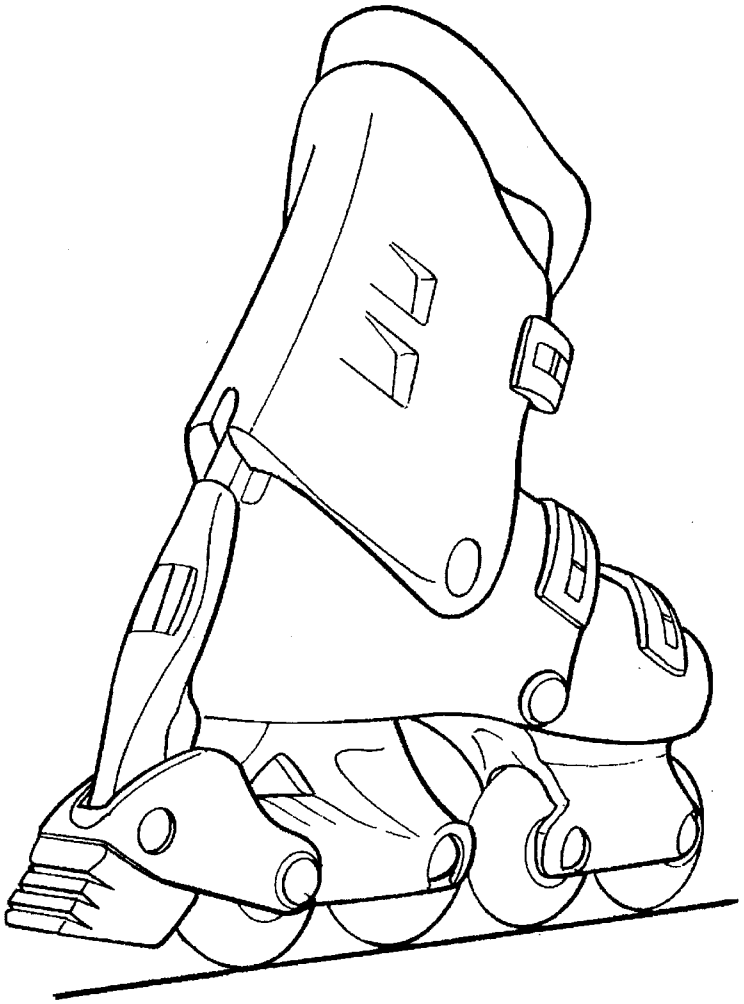
FIG. 5 is a rear perspective view of the skate of FIG. 4 during normal skating.

Optionally, as illustrated in FIGS. 4–6, an adapted support for a brake that interacts with the ground when the second body 8 is rotated backwards is associated at the second frame 12.

Said second body, as shown in FIG. 4, can be advantageously constituted by two elements, such as a quarter 17 articulated to a shell portion 18 to allow a support 19, for a brake 20 that interacts with the ground, to be articulated to the second frame 12, said support 19, however, being articulated to the rear and transversely with respect to the quarter 17 by means of a rod member 21.

Advantageously, the oscillation of the quarter 17 with respect to the shell portion 18 is guided by an adapted first pivot 22 protruding laterally with respect to the shell portion 18 and acting within an adapted curved first slot 23 that is formed laterally with respect to the quarter 17.

The first body 2 is slidingly associated with the second body 8 by means of an adapted tab 24 protruding to the rear and below the first body 2 along an axis that is approximately central and longitudinal. Said tab 24 is slidingly associated at an adapted seat 25 formed at the heel resting region in the second body 8.

The mutual sliding of said first and second bodies can be locked by means of adapted screws or rivets that affect a first pair of holes 26 formed on the first body 2 proximate to the tab 24 and a second pair of holes 27 formed on the seat 25 of the second body 8.

The first and second bodies are rotatably associated by means of an adapted pair of studs 28, the stem whereof affects a third pair of holes 29 formed laterally and proximate to the open rear end of the first body 2, as well as a pair of second slots 30 formed laterally to the second body 8 proximate to the seat 25.

It is also possible to provide a fourth pair of holes as an alternative to the second slots 30.

In order to allow better comfort for the user, a soft innerboot 31 can be inserted into the first and second bodies.

The use of the skate according to the invention is therefore as follows: once the first body and the second body have been mutually positioned in a stable or sliding manner, the skater can produce the pushing condition so as to apply forces only at the first frame 5 that protrudes below the first front body 2, at the same time articulating the foot during this step, since the foot is assisted by the articulation between said first and second bodies.

In this manner, the user, on one hand, improves force transmission during the pushing action and, on the other hand, allows the foot to perform these movements in an anatomically correct manner, since it is possible to raise the second frame 12 from the ground, at the same time eliminating friction between the second wheels 14 and the ground.

It is thus evident that the invention has achieved the intended aim and objects, a skate having been provided that allows to optimally achieve pushing action during sports practice, furthermore increasing comfort for the user, since the foot performs an anatomically correct movement to achieve the pushing action.

Furthermore, the lifting of the second wheels 14 from the ground during this pushing step allows to reduce friction with the ground, further improving the results that can be achieved.

Furthermore, the presence of the upper longitudinal opening 4 provided in the first body 2 allows, also by virtue of the corresponding opening formed on the second body 8, to perform the mutual oscillations of the first and second bodies with great comfort for the user, since there are no rigid elements that undergo deformations during oscillation.

The skate according to the invention is of course susceptible of numerous modifications and variations within the scope of the same inventive concept.

The materials and the dimensions that constitute the individual components of the structure may of course also be the most pertinent according to the specific requirements.

What is claimed is:

1. A roller skate comprising:

a front body for surrounding at least a user's toe region;

a rear body for surrounding at least a user's heel region;

a front wheel supporting frame rigidly connected to said front body and rotatably supporting at least one front wheel; and a rear wheel supporting frame rigidly connected to said rear body and rotatably supporting at least one rear wheel;

wherein said front wheel supporting frame is a separate element from said rear wheel supporting frame; and wherein said front body and said rear body are pivotally connected together by a pivotal connection such that in use said at least one front wheel maintains contact with a wheel supporting surface while said rear body pivots with respect to said front body raising said at least one rear wheel out of contact with respect to the wheel supporting surface.

2. The roller skate of claim 1 wherein said pivotal connection is positioned above an arch region of the roller skate.

3. The roller skate of claim 1 comprising two aligned front wheels rotatably supported by said front wheel supporting frame and two aligned rear wheels rotatably supported by said rear wheel supporting frame.

4. The roller skate of claim 1 comprising a longitudinal opening extending in both of said front and rear bodies at a foot instep region of the roller skate.

5. The roller skate of claim 1, wherein said front body and said rear body are mutually separate elements which are pivotally connected together by said pivotal connection.

6. The roller skate of claim 1 further comprising an innerboot accommodated inside said front and rear bodies.

7. The roller skate of claim 1 comprising a lower tab extending from one of said front and rear bodies and slidingly engaged in a lower seat formed in the other of said front and rear bodies.

8. A roller skate comprising:

a front body for surrounding at least a user's toe region;

a rear body for surrounding at least a user's heel region;

a front wheel supporting frame rigidly connected to said front body and rotatably supporting at least one front wheel; and a rear wheel supporting frame rigidly connected to said rear body and rotatably supporting at least one rear wheel;

wherein said front wheel supporting frame is a separate element from said rear wheel supporting frame; and wherein said front body and said rear body are pivotally connected together by a pivotal connection such that in use said at least one front wheel maintains contact with a wheel supporting surface while said rear body pivots with respect to said front body raising said at least one rear wheel out of contact with respect to the wheel supporting surface; and wherein said rear body extends for supporting said heel region and a user's tibial region; and wherein said rear body includes a lower shell portion and an upper quarter pivotally connected to said lower shell portion.

9. The roller skate of claim 8 further comprising a braking element pivotally connected to said rear wheel supporting frame and a rod member connected between said braking element and said upper quarter such that said braking element may engage with the wheel supporting surface upon a rotation of said upper quarter with respect to said lower shell portion.

10. A roller skate comprising:

a front body for surrounding at least a user's toe region;

a rear body for surrounding at least a user's heel region;

a front frame means rigidly connected to said front body for rotatably supporting at least one front wheel; and a rear frame means rigidly connected to said rear body and rotatably supporting at least one rear wheel;

wherein said front wheel supporting frame is a separate element from said rear wheel supporting frame; and wherein said front body and said rear body are pivotally connected together by a pivotal connection means for mutually pivotally connecting said front body and said rear body such that in use said at least one front wheel maintains contact with a wheel supporting surface while said rear body pivots with respect to said front body raising said at least one rear wheel out of contact with respect to the wheel supporting surface.

11. The roller skate of claim 10 wherein said pivotal connection means is positioned above an arch region of the roller skate.

12. The roller skate of claim 10 comprising two aligned front wheels rotatably supported by said front frame means and two aligned rear wheels rotatably supported by said rear frame means.

13. The roller skate of claim 10 comprising a longitudinal opening extending in both of said front and rear bodies at a foot instep region of the roller skate.

14. The roller skate of claim 10, wherein said front body and said rear body are mutually separate elements which are pivotally connected together by said pivotal connection means.

15. The roller skate of claim 10 further comprising an innerboot accommodated inside said front and rear bodies.

16. The roller skate of claim 15 further comprising a braking element pivotally connected to said rear frame means and a rod member connected between said braking element and said upper quarter such that said braking element may engage with the wheel supporting surface upon a rotation of said upper quarter with respect to said lower shell portion.

17. The roller skate of claim 10 comprising a lower tab extending from one of said front and rear bodies and slidingly engaged in a lower seat formed in the other of said front and rear bodies.

18. A roller skate comprising:

a front body for surrounding at least a user's toe region;

a rear body for surrounding at least a user's heel region;

a front frame means rigidly connected to said front body for rotatably supporting at least one front wheel; and a rear frame means rigidly connected to said rear body and rotatably supporting at least one rear wheel;

wherein said front wheel supporting frame is a separate element from said rear wheel supporting frame; and wherein said front body and said rear body are pivotally connected together by a pivotal connection means for mutually pivotally connecting said front body and said rear body such that in use said at least one front wheel maintains contact with a wheel supporting surface while said rear body pivots with respect to said front body raising said at least one rear wheel out of contact with respect to the wheel supporting surface; and wherein said rear body extends for supporting said heel region and a user's tibial region; and wherein said rear body includes a lower shell portion and an upper quarter pivotally connected to said lower shell portion.

* * * * *